United States Patent [19]

Wozniak

[11] Patent Number: 4,793,219

[45] Date of Patent: Dec. 27, 1988

[54] METHOD OF MANUFACTURING NON-SLIP THREAD ROLLING DIES

[75] Inventor: Edmund T. Wozniak, Cleveland, Ohio

[73] Assignee: Colt Industries Operating Corporation, W. Hartford, Conn.

[21] Appl. No.: 112,524

[22] Filed: Oct. 26, 1987

Related U.S. Application Data

[62] Division of Ser. No. 865,756, May 22, 1986, Pat. No. 4,716,751.

[51] Int. Cl.[4] ..... B21K 5/20

[52] U.S. Cl. ..... 76/107 R; 72/469; 219/69 M; 219/121.69

[58] Field of Search ..... 72/469, 88, 90, 103, 72/104, 108; 76/107 R; 219/69 M, 69 V, 69 R, 121 LH, 121 LJ; 204/129.46

[56] References Cited

U.S. PATENT DOCUMENTS

| | | | |
|---|---|---|---|
| 1,961,257 | 6/1934 | Thomson | 72/469 |
| 3,339,389 | 9/1967 | Moscow | 72/469 |
| 3,405,545 | 10/1968 | Orlomoski | 72/469 |
| 3,653,241 | 4/1972 | Orlomoski | 72/469 |
| 3,889,516 | 6/1975 | Yankee et al. | 72/469 |
| 4,411,147 | 10/1983 | Capuano | 72/88 |
| 4,563,890 | 1/1986 | Dickson | 72/88 |
| 4,573,496 | 3/1986 | Richard | 219/69 V |

FOREIGN PATENT DOCUMENTS

| | | | |
|---|---|---|---|
| 7860 | 3/1968 | Japan | 219/69 M |
| 65032 | 5/1980 | Japan | 219/69 M |
| 764806 | 9/1980 | U.S.S.R. | 72/469 |
| 2162454 | 2/1986 | United Kingdom | 219/69 M |

OTHER PUBLICATIONS

Bement, R.A., et al., "Electroforming A Profile Tool," From *IBM Technical Disclosure Bulletin*, vol. 15, No. 11, Apr. 1973, pp. 3480.

*Primary Examiner*—Daniel C. Crane

*Attorney, Agent, or Firm*—Pearne, Gordon, McCoy & Granger

[57] ABSTRACT

Thread rolling dies are disclosed which are provided with a band of roughness extending along the flanks of the thread forming grooves in the dies. The roughened bands provide traction between the blank and the dies so as to establish rolling without slippage at about the initial blank diamter. The roughened band is produced by electric discharge machining or grinding, using a precision-formed electrode. The electrical power applied during the formation of the roughened band is controlled so that the greatest amount of roughness, and in turn traction, is provided at the start end of the die and the band is provided with a progressively decreasing amount of roughness as it extends toward the finish end of the die. The band of roughness ends at a location spaced from the finish end of the die so that the flanks of the thread formed on the blank are smooth at the completion of the rolling operation. Improved quality threads are achieved by controlling the slippage between the die and the blank without producing objectionable laps in the finished thread. Also, wavy or drunken threads are eliminated because the blank tends to remain in match as it rolls along the die faces. Better die life is also achieved because the match between the blank and the dies is maintained.

8 Claims, 1 Drawing Sheet

METHOD OF MANUFACTURING NON-SLIP THREAD ROLLING DIES

This is a division of application Ser. No. 06/865,756, filed May 22, 1986, now U.S. Pat. No. 4,716,751 issued Jan. 5, 1988.

BACKGROUND OF THE INVENTION

This invention relates generally to the production of threaded fasteners, and more particularly to novel and improved thread rolling dies, a novel and improved method and apparatus for producing such dies, and novel and improved threaded fasteners produced by such dies.

PRIOR ART

Thread rolling dies are often provided with means to resist slippage between selected die surfaces and the blank being rolled thereby. For example, it is well known to provide serrations across the face of the die, at least at the start end thereof. The Orlomoski U.S. Pat. No. 3,405,545 discloses an example of a die formed with such serrations.

It is also known to provide thread rolling dies with a roughened surface to resist slippage between the blank and the dies, particularly at the start end of the die where the blank is initially gripped. Such roughened surface is often produced by sandblasting. An example of such dies is illustrated in the Thomson U.S. Pat. No. 1,961,257.

It is also known to provide thread rolling dies with a hardened, nodularized rough surface coating along the crests of the thread forming grooves of the dies. The Yankee U.S. Pat. No. 3,889,516 describes an example of such dies. All of such patents are incorporated herein by reference.

In the past, the practice has generally been to form the roughened surface along the crests of the thread forming grooves of the die, which is the surface which initially engages the blank being threaded. Further, the roughened or traction forming surface along the crest has normally been provided primarily along the start end of the die which engages the blank when it is initially gripped and must commence to rotate and roll along the die surface. Even when sandblasting techniques are utilized to roughen the die surface, the roughness which occurs along the crests of the die's thread forming grooves tends to be more pronounced than the roughness along the flanks because the angle of the thread forming groove flanks renders the sandblasting operation less effective in roughening the flanks of the groove than the roughening along the crest surface on the dies.

Most thread rolling dies are designed for rolling the blank without slippage at about the initial blank diameter. With such rolling at initial blank diameter, the blank tends to remain in match as the blank rolls along the length of the die and a good quality thread is formed.

The practice of providing traction serrations or a rough surface along the crests of the die has been followed to a large extent because it has not been considered feasible to locate the roughness for traction surface along the die thread flanks. When the roughness is along the die thread crests, the blank tends to roll without slippage along the die thread crests and the blanks tend to lose proper match as they roll along the dies. When mismatch occurs, the blanks tend to move along their axis with respect to the dies to maintain a matched condition. If such axial movement is sufficiently severe, the threads produced on the blank tend to be wavy, and are often referred to as "drunken threads." Such threads are unsatisfactory, and usually result in rejections of the parts produced. Further such axial movement produces excessive die pressures, which can cause premature die failure.

Further, when serrations are provided on the dies to prevent slippage, objectionable laps are often produced. As the blank rolls across the serrations, metal flows into the serrations, forming significant projections. The projections are subsequently re-formed and often are folded over, producing a lap in the root or along the blank adjacent to the root of the thread formed on the blank. These laps weaken the thread and are unacceptable in high quality fasteners. Consequently, in many cases, serrations cannot be used in the dies for the production of high quality fasteners, and are also undesirable in the production of standard quality fasteners.

SUMMARY OF THE INVENTION

This invention relates generally to novel and improved thread rolling dies, a novel and improved method and apparatus for producing such dies, and novel and improved fasteners formed by such dies.

Thread rolling dies in accordance with this invention are formed with grooves structured to promote non-slip rolling of the blank substantially at the initial blank diameter. This is accomplished by providing a roughened slip-resistant band or surface extending along the flanks of the thread forming grooves of the dies. The adjacent surfaces of the thread forming grooves on each side of the roughened band are substantially smooth. With this structure, the blank tends to roll without slippage at the blank diameter and the amount of slippage on either side of the pitch diameter is minimal. Further, the match of the blank is maintained as the threads are produced. Therefore, the stresses on the die are reduced and die life is improved.

The roughened bands along the flanks of the thread forming groove in the illustrated embodiment are formed by electrical discharge machining or grinding, generally referred to as "EDM" or "EDG." Such method is capable of economically producing the roughened bands with precision even in the very confined location of the flanks of the thread forming groove of the thread rolling die.

With such method of producing a die, a precision-formed electrode is shaped to provide a surface only adjacent to the desired band location, and the die and electrode are immersed in a dielectric fluid. Electrical power is then applied between the die and the electrode to produce a spark or arc between the die and the adjacent surface of the electrode. Such arc causes particles of metal at the surface of the die to melt and be vaporized. Such particles immediately resolidify in the dielectric fluid, and are flushed away thereby.

By properly adjusting the electric power applied between the die and the electrode, a band having a roughened slip-resistant surface is produced at the precise location desired. The illustrated embodiment involves the use of EDM or EDG. However, it is within the broader aspects of this invention to use other forms of precision electric discharge surface treatment techniques, and even laser, to produce the roughened surface along the die thread flanks.

Because the non-slip rolling is maintained at the initial blank diameter, substantial ideal flow of blank material into the thread form occurs. Therefore, the threaded fastener produced in accordance with this invention is of improved quality.

Further, because the roughened surface does not provide large indentations but, rather, small surface irregularities, laps are not produced even when the crests are roughened at the start end of the die.

These and other aspects of this invention are illustrated in the accompanying drawings, and are more fully described in the following specification.

DETAILED DESCRIPTION OF THE DRAWINGS

Figure 1:
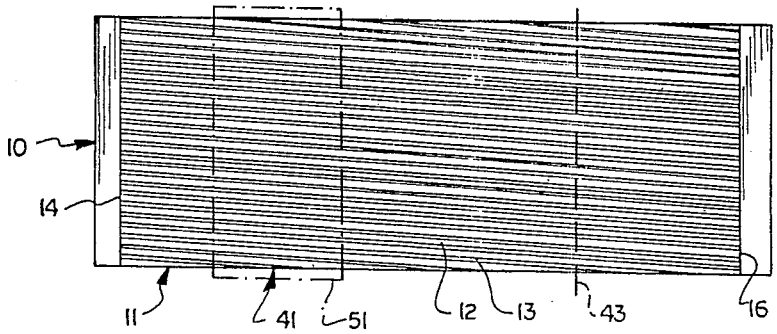
FIG. 1 is a plan view of the working surface of a typical die.
Figure 1A:
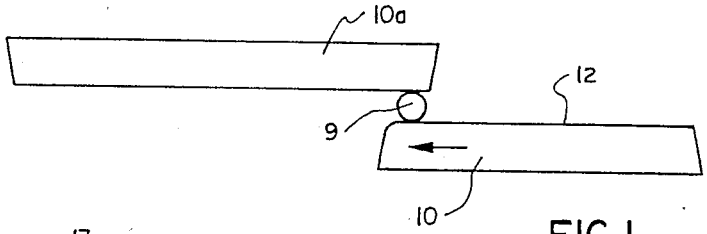
FIG. 1*a* illustrates a pair of dies of the type illustrated in FIG. 1 rolling a thread on a fastener blank.

FIG. 1*a* illustrates typical flat thread rolling dies 10 and 10*a* incorporating the present invention rolling a blank 9. The die 10 illustrated in FIG. 1 is the short die of the pair, but in all significant respects the two dies are identical, so only the die 10 is described in detail, with the understanding that such description also applies to the die 10*a*.

The die 10 is normally formed of a tool steel body 11 having a working face 12 along which the blank rolls during the forming operation. The working face is provided with die threads 13 which extend from a start end of the die 14 to a finish end 16 of the working face. The die threads are sized and shaped so that as a blank 9 rolls between two mating dies from the start end 14, the material of the blank is progressively displaced and flows into the die threads as the blank rolls along the working face to the finish end 16. When the blank reaches the finish end, a fully formed thread is produced thereon which mates with the die threads.

Figure 2:
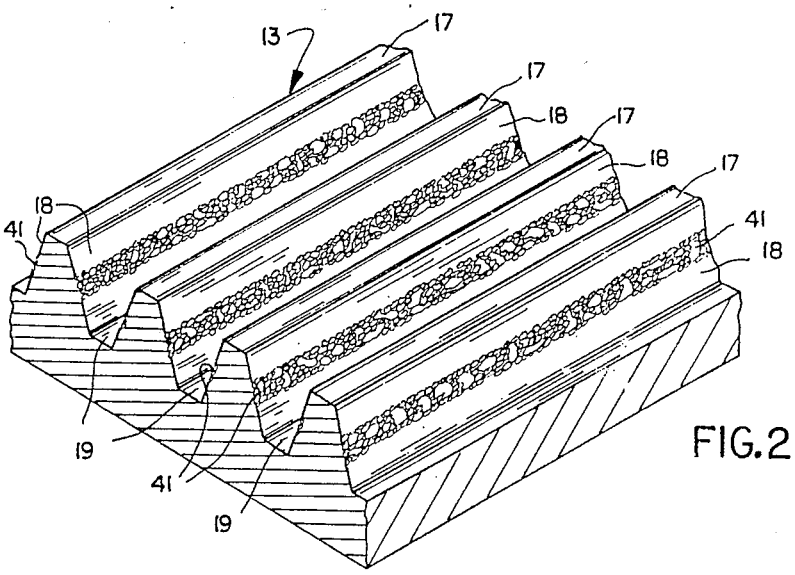
FIG. 2 is an enlarged, fragmentary cross section illustrating a die thread form provided with a roughened band extending longitudially along the central portion of the flank of the thread forming grooves on the die.

Referring to FIG. 2, the die threads 13 provide crests 17 which penetrate into the blank material during the rolling operation and ultimately form the roots of the threads on the blank. Similarly, the die threads 13 are provided with flanks 18 along which the material of the blank flows during the rolling operation to form the flanks of the threads on the blank. The roots 19 of the die threads ultimately form the crests of the thread on the blank at the completion of the rolling operation.

When the blank 9 is initially gripped between the pair of opposed dies at the start end 14, the surface of the blank initially engages the crest 17 of the die threads and commences to roll along the die surfaces as the dies reciprocate relative to each other. However, most thread forming dies are formed so that substantial penetration occurs near the start of the rolling process. Therefore, the blank material flows down along the die thread flanks 18 very quickly in the rolling process. As the rolling progresses, the material of the blank continues to be displaced down along the flanks 18, with the depth of penetration increasing as the rolling continues, until a fully formed thread is produced at the finish end 16 of the dies. As the blank rolls through its final turns along the die surface, the rate of deformation is reduced and the thread shape and surface are finished.

It is therefore preferable to construct the die so that the roughened band terminates at a location at about 43, about two-thirds of the length of the die from the start end, so that the last portion of the rolling of the blank occurs against smooth surfaces. Therefore, even the flanks of the blank surface of the thread become smooth. Further, it is preferable to arrange the roughness of the band 41 so that the greatest degree of roughness is provided adjacent to the start end 14 of the die and so that the degree of roughness progressively decreases along the band to the point 43. With such a structural arrangement, the greatest amount of traction between the blank and the band 41 is provided near the forward end of the die, and as the thread is being finished, the amount of roughness is decreased so that the finished blank thread will not have a rough flank.

It is recognized that at the point of initial engagement, the blank material does not extend into the groove any appreciable extent; therefore, the roughened band need not commence exactly at the start end of the die, but it should commence at least in the zone where the blank material commences to extend down along the flanks. In fact, since the initial engagement is only at the crests 17, it is desirable in some cases to also produce a roughened crest surface at the start end of the die to provide traction to start the blank rolling along the working face. The initial blank diameter of machine screws is substantially equal to the pitch diameter of the screw, so that when the dies are structured to roll a machine screw, the roughened band is formed at about the midpoint of the flanks 18.

Figure 3:
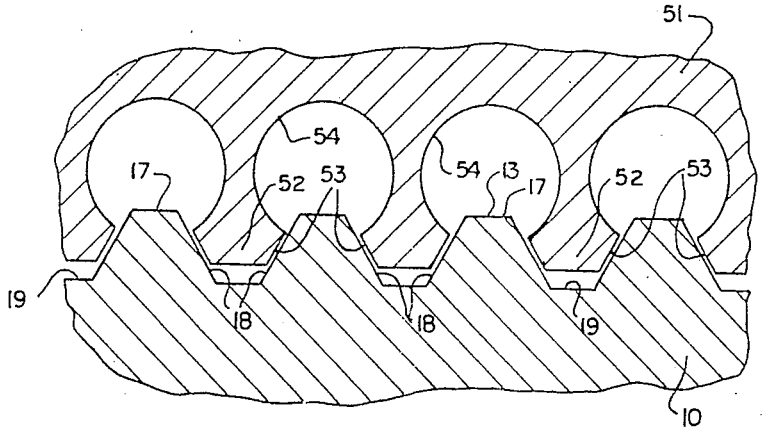
FIG. 3 is an enlarged, fragmentary section illustrating the shape of one electrode which may be used to produce the roughened band along the die thread flanks by EDM or EDG processes.
Figure 4:
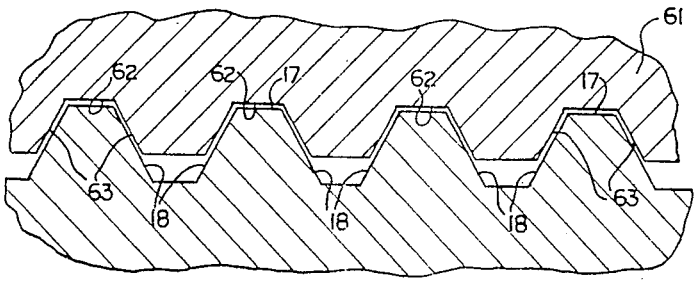
FIG. 4 is an enlarged, fragmentary section similar to FIG. 3 but illustrating an electrode shaped to produce a roughened surface along both the crests of the thread and a portion of the flanks of the die threads.

FIGS. 3 and 4 illustrate the structure of two different electrodes which may be used to form the roughened surface on the threads of the blank by electric discharge machining or grinding. For the portions of the die along which only the roughened band 41 is to be produced without corresponding roughening of the crests 17, the roots 19, or the flanks 18 on either side of the band, an electrode 51 is provided. Such electrode is formed with a toothlike structure 52 which extends between the die threads 13 and provides a surface 53 positioned in close proximity to the flanks 18. The toothlike structure 52, however, terminates at a location spaced from the roots 19. Further, the electrode 51 is undercut along a circular portion 54 to space the electrode from the upper portions of the flanks 18 and also from the crests 17 of the die thread form. The width of the surfaces 53 is preferably equal to the width of the desired roughened band 41, and the remainder of the electrode is substantially spaced from all other surfaces of the die.

When the electrode 51 and the die 10 are immersed in a dielectric fluid and electrical power is appropriately applied between the two, arcing occurs only between the surface 53 and the adjacent surface of the flanks of the threads. Consequently, a roughened zone is only produced at such location. As mentioned previously, it is desirable to produce a rougher surface on the band at the start end of the die. Consequently, the electrode has a length substantially less than the length of the blank as represented by the phantom view of the electrode 51 in FIG. 1. In practice, the electrode is positioned substantially at the start end of the working face, as illustrated in FIG. 1, and the power is applied in such a way as to produce substantial roughening along the band 41 at such zone. Thereafter the electrode 51 is moved to progressive positions toward the point 43 and the power is adjusted so as to produce roughening with decreased severity progressively toward the point 43, where further roughening is terminated.

In instances in which it is desired to use electric discharge machining or grinding along the crests 17 as well as the flanks 18 at the start end of the die, an electrode 61 illustrated in FIG. 4 is used. Such electrode is similar to the electrode 51 except for the undercut portion 54. Therefore, the electrode is provided with a shallow tooth shape providing a root portion 62 adjacent to the die crest 17 and flank portions 63 adjacent to the upper portion of the die flanks 18. When such electrode is utilized, roughening occurs along both the crests 17 and a portion of the flanks 18. Such roughening, however, should only be used at the beginning of the die so that rolling along the zone of initial blank diameter will occur as soon as the flow of the blank material progresses down along the flank a significant distance. Here again, the degree of roughening desired is controlled by the manner in which the power is applied.

It is feasible to produce relatively narrow bands 41 of roughened surface, even in the confines of relatively small threads, because of the precision with which electric discharge machining can be performed. Further, by properly applying the power, only an insignificant amount of material is eroded away during the formation of the roughened band 41 so that the roughened surface is not undercut.

With the present invention, improved dies can be economically produced in which substantially ideal non-slip rolling is achieved. With such dies, proper match between the dies and the blank being rolled is achieved so that the blank does not produce unnecessary stresses on the die and improved die life is obtained. Further, because the blank rolls in proper match, a better thread is formed. Still further, the quality of the fastener is improved because the metal of the fastener does not fold into laps and the like.

Although the preferred embodiment of this invention has been shown and described, it should be understood that various modifications and rearrangements of the parts may be restored to without departing from the scope of the invention as disclosed and claimed herein.

What is claimed is:

1. A method of producing thread rolling dies comprising forming metal bodies with working faces extending from a start end to a finish end, producing thread forming grooves in said working faces extending between said start end and said finish end, providing said grooves with crests, flanks, and roots, and removing portions of metal from said flanks to provide a roughened band of surface irregularities along each flank having a width at least along a portion of said band less than the width of its associated flank while leaving a surface of said flank adjacent to at least said portion of said band substantially smooth.

2. A method as set forth in claim 1, including forming said bands to a location spaced from said finished end and providing a smooth surface on said grooves from the ends of said bands to said finish end.

3. A method as set forth in claim 2, including forming said bands by one of the processes including electric discharge machining and electric discharge grinding.

4. A method as set forth in claim 3, including the step of positioning an electrode adjacent to the surface of said flanks and spaced from the remaining adjacent surfaces of said grooves, positioning said electrode and said body in a dielectric fluid, and applying an electrical potential between said body and electrode to cause arcing therebetween to erode the surface of said body and produce said roughened band.

5. A method as set forth in claim 4, including applying said potential so that said roughened band is roughest adjacent to said start end and extends with reduced roughness toward said finished end.

6. A method as set forth in claim 4, including providing said electrode with a length less than the length of said band required in said dies and progressively positioning said electrode along the length of said dies, and adjusting said potential to produce substantial roughness adjacent to said start end and progressively reduce roughness toward said finished end.

7. A method as set forth in claim 3, including positioning said band substantially adjacent to the center of said flank.

8. A method as set forth in claim 3, including forming said crests at said start end with a traction surface.

* * * * *